US006009775A

United States Patent [19]

Thompson et al.

[11] Patent Number: 6,009,775

[45] **Date of Patent: *Jan. 4, 2000**

[54] WRENCH WITH HIGH INERTIA TORQUE SYSTEM AND METHOD FOR USING SAME

[75] Inventors: Owen R. Thompson, Louisville, Ky.; Edward J. Weber, Girard; Jerry L. Rounds, Erie, both of Pa.

[73] Assignee: Titan Tool Company, Fairview, Pa.

[ * ] Notice: This patent is subject to a terminal disclaimer.

[21] Appl. No.: 09/251,345

[22] Filed: Feb. 17, 1999

Related U.S. Application Data

[63] Continuation of application No. 08/756,487, Nov. 26, 1996.

[51] Int. Cl.[7] ..... B36B 13/00; B36B 21/00

[52] U.S. Cl. ..... 81/54; 81/467

[58] Field of Search ..... 81/54, 429, 467, 81/473, 475; 192/93 C, 71, 76, 103

[56] References Cited

U.S. PATENT DOCUMENTS

| | | | |
|---|---|---|---|
| 1,251,611 | 1/1918 | Zaleski | 192/69.8 |
| 2,530,915 | 11/1950 | Stec . | |
| 2,533,703 | 12/1950 | Wilhide et al. | 81/467 |
| 3,437,188 | 4/1969 | Long | 192/103 F |
| 4,273,229 | 6/1981 | Voll | 192/93 C |
| 4,316,512 | 2/1982 | Kibblewhite et al. | 81/54 |
| 4,505,170 | 3/1985 | Van Laere | 81/467 |
| 4,871,033 | 10/1989 | Odoni et al. . | |
| 4,892,013 | 1/1990 | Satoh . | |
| 5,076,120 | 12/1991 | Lin | 81/54 |
| 5,095,784 | 3/1992 | Garver . | |
| 5,158,354 | 10/1992 | Simonin | 81/54 |
| 5,412,546 | 5/1995 | Huang | 81/54 |
| 5,568,849 | 10/1996 | Saski et al. | 81/429 |

FOREIGN PATENT DOCUMENTS

| | | |
|---|---|---|
| 172609 | 9/1983 | Netherlands . |
| 1215982 | 3/1986 | U.S.S.R. . |
| 1308457 A1 | 5/1987 | U.S.S.R. . |
| 1719193 A1 | 3/1992 | U.S.S.R. . |

OTHER PUBLICATIONS

English–language abstract of NL172609.
English–language abstract of SU 1215982 A.
English–language abstract of SU 1308457 A1.
English–language abstract of SU 1719193 A1.

*Primary Examiner*—David A. Scherbel
*Assistant Examiner*—Lee Wilson
*Attorney, Agent, or Firm*—Oliff & Berridge, PLC

[57] ABSTRACT

A wrench utilizing high inertial torque energy incorporates a flywheel that is rotated by a drive motor. The wrench is activated by a symmetrical clutch to deliver the rotational energy stored in the flywheel to an output drive. Torque reaction is isolated in the flywheel and clutch mechanism and not transmitted to the housing of the wrench.

13 Claims, 15 Drawing Sheets

WRENCH WITH HIGH INERTIA TORQUE SYSTEM AND METHOD FOR USING SAME

This is a Continuation of application Ser. No. 08/756,487 filed Nov. 26, 1996. The entire disclosure of the prior application (s) is hereby incorporated by reference herein in its entirety.

BACKGROUND OF THE INVENTION

1. Field of the Invention

This invention relates to a wrench that utilizes a flywheel to create a high inertia torque system for removing fastening devices and a method for using the wrench.

2. Background of Related Art

A wrench that transfers energy stored in a flywheel to a bolt or nut which is to be loosened is conventionally known in the automobile lugnut removal field. U.S. Pat. No. 5,158,354 to Simonin discloses a conventional wrench with a drive motor and flywheel that are rigidly connected in a housing to drive an output ferrule when a spring clutch is engaged. In operation, a user provides power to the drive motor which causes a flywheel to rotate. Once the flywheel achieves a predetermined speed, the user presses the output ferrule onto a lugnut which causes a single tooth clutch plate connected to the ferrule to collide with a mating single tooth clutch plate connected to the flywheel. The rotational energy from the flywheel is then transferred to the output ferrule to provide a removal force to a lugnut engaged by the ferrule. The conventionally known wrench is designed for the specific purpose of quickly removing a flat tire. Accordingly, the conventional wrench is designed to be economically made with little concern for accuracy or endurance.

Because the motor of the conventionally known flywheel wrench is rigidly connected to the housing, a torque reaction will be transmitted directly to the user of the device. Torque reaction is a detrimental reverse torque which results from the elastic collision of the clutch mechanism when the rotational energy transmitted from the flywheel to the output ferrule is converted to a torque for removing a fastener. Transmission of torque reaction to an operator can lead to many undesirable health problems including nerve damage, muscle strain and bruising. Torque reaction is especially large when the rotational energy stored in the flywheel is not sufficient to remove the fastener to which the output ferrule is connected. Torque reaction is also compounded when any of the mechanisms that are rotated are not concentric. The nature and object of conventionally known flywheel wrenches has never demanded a strict limit to the amount of torque reaction that is acceptable because conventionally known flywheel wrenches are generally used in lightweight limited use applications, such as removing a lugnut from an automobile wheel. Accordingly, the detrimental effects of torque reaction being transmitted to an operator are negligible in conventionally known flywheel wrenches and do not outweigh the benefits of making the device economical and compact.

In heavier, industrial applications, it is conventionally known to use an impact wrench to remove fasteners. The impact wrench also suffers from the problem of transmission of torque reaction to the operator. In addition, the user of an impact wrench has little control over the amount of torque that is output by the tool. Torque output from air operated power equipment, such as an impact wrench, varies greatly depending on the air pressure, amount of moisture in the air and the condition of the motor itself. Furthermore, impact wrenches require a relatively large amount of input power to achieve a given output torque.

SUMMARY OF THE INVENTION

The present invention has been made in view of the above problems. An object of the invention is to provide an economical and efficient wrench that transmits little torque reaction from the output drive to the wrench housing. Another object of the invention is to provide a wrench that can be easily and accurately controlled to provide a specific torque output. A further object of the invention is to provide a wrench that can be used while suspended by a cable without requiring the physical control of an operator during use. Yet another object of the invention is to provide a wrench that requires a small power input to achieve a large torque output.

According to a first aspect of the invention, there is provided a power driven wrench in which a drive motor is located inside a housing. An inertial mass for example, a flywheel is connected to the drive motor such that it can be rotationally driven. An output drive mechanism is located at an output end of the inertial mass. The inertial mass and the drive motor are connected to the housing such that they can rotate with respect to the housing to substantially prevent torque reaction from being transmitted to the housing.

According to a second aspect of the invention, a power driven wrench is provided in which an inertial mass is connected to a drive motor for rotation about an axis of symmetry of the inertial mass. An output drive mechanism is located at an output end of the inertial mass. The output drive mechanism is connected to the inertial mass by a clutch mechanism that has a clutch axis of symmetry coincidental with the axis of symmetry of the inertial mass.

According to a third aspect of the invention, there is provided a method for removing a fastening device by using energy stored in a rotating inertial mass. The method includes providing an inertial mass connected to a drive motor, the inertial mass being connected by a symmetrical clutch mechanism to an output drive member for connecting to and driving the fastening device. The method further includes rotating the inertial mass at a predetermined rotational speed to impart a predetermined amount of kinetic energy to the inertial mass. Finally, the method includes the step of engaging the symmetrical clutch mechanism to transfer the rotational energy from the inertial mass, through the output drive member, to the fastening device.

These and other advantages will be described in or apparent from the following detailed description of preferred embodiments.

BRIEF DESCRIPTION OF THE DRAWINGS

Preferred embodiments will be described with reference to the following drawings, in which.

DETAILED DESCRIPTION OF PREFERRED EMBODIMENTS

Figure 1C:
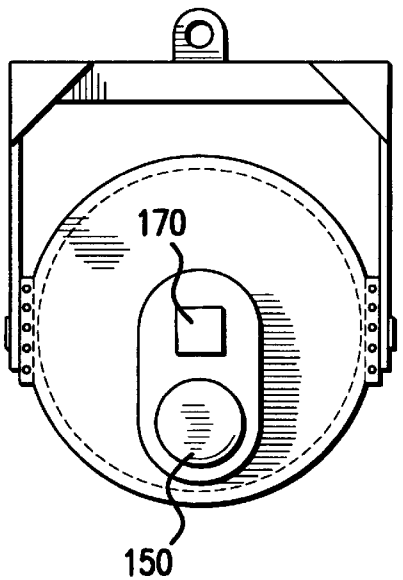
FIGS. 1*a*–1*c* are end, side and opposite end views, respectively of a first embodiment of the present invention.
Figure 1B:
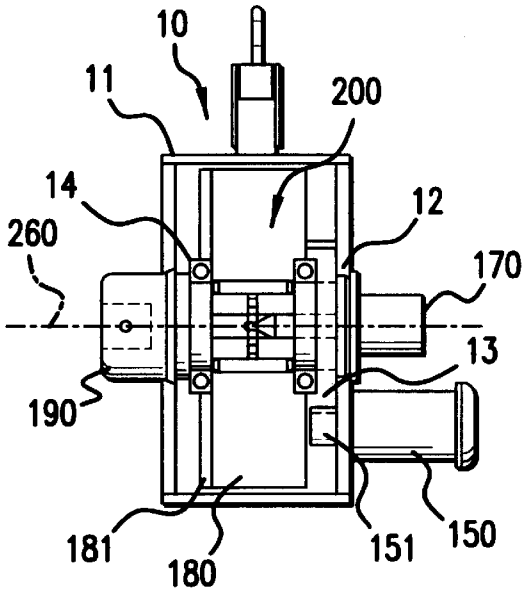

A first preferred embodiment of the present invention will now be described with references to FIGS. 1*a*–1*c*.

A wrench 10 includes a wrench housing 11 from which an output drive 190 extends from an output end of the wrench housing 11. The output drive 190 is preferably a three and one-half inch male drive square made from S5 steel. However, any material that is capable of withstanding repeated severe impacts can be used. In addition, a female square could be used instead of a male square.

A drive motor 150 and pneumatic cylinder 170 are located on the wrench housing 11 at a position opposite the output end of the wrench housing 11. The drive motor 150 is preferably a pneumatic drive motor that transmits rotational energy to an inertial mass, for example a flywheel 180 located inside of wrench housing 11 and rotatable about a central drive axis 260. The rotational energy is transmitted by a set of gears, such as motor gear 151 and drive gear 13. A helper flywheel 181 can be used in cooperation with the flywheel 180 when an additional amount of output torque is desired to be available at a certain speed (rpm) of the flywheel 180 and helper flywheel 181. The helper flywheel 181 can be connected to the flywheel 180 by any known conventional means, such as bolts, adhesives or a helper flywheel clutch mechanism.

Figure 1A:
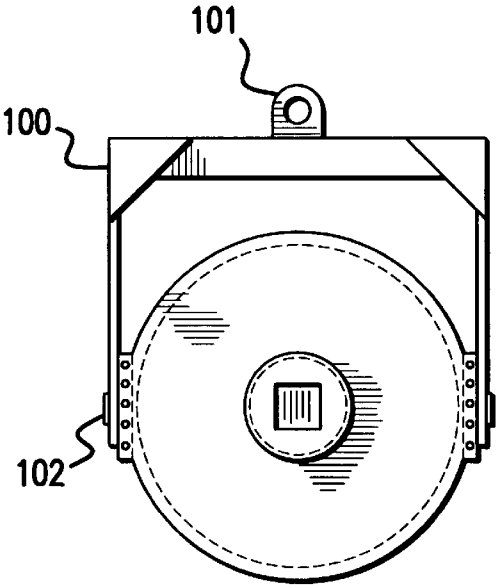
Figure 2A:
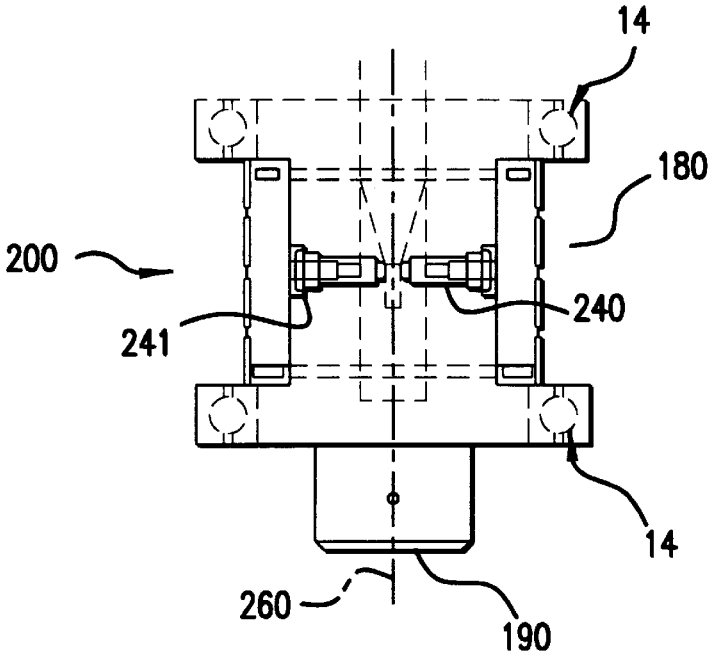
FIGS. 2*a*–2*d* are top and end views of the clutch of the first embodiment in a disengaged position (FIGS. 2*a*–2*b*) and an engaged position (FIGS. 2*c*–2*d*)
Figure 2B:
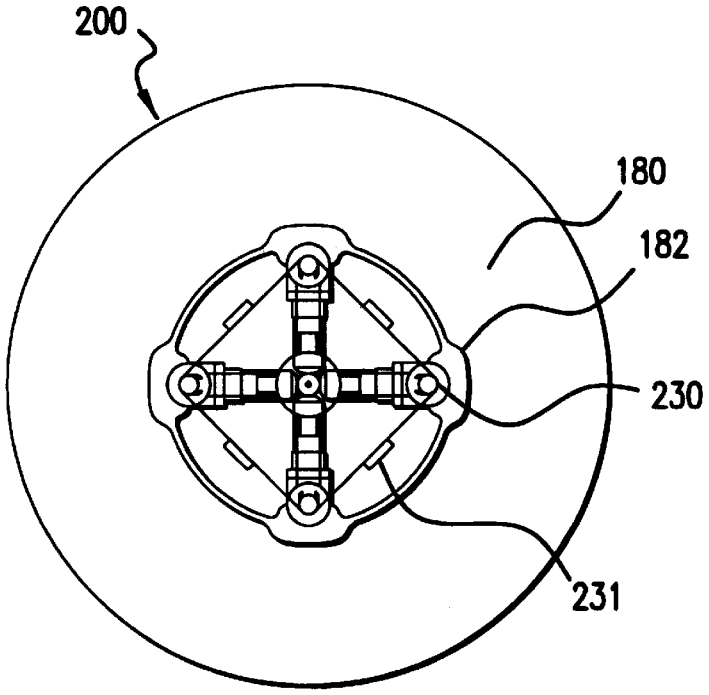
Figure 2C:
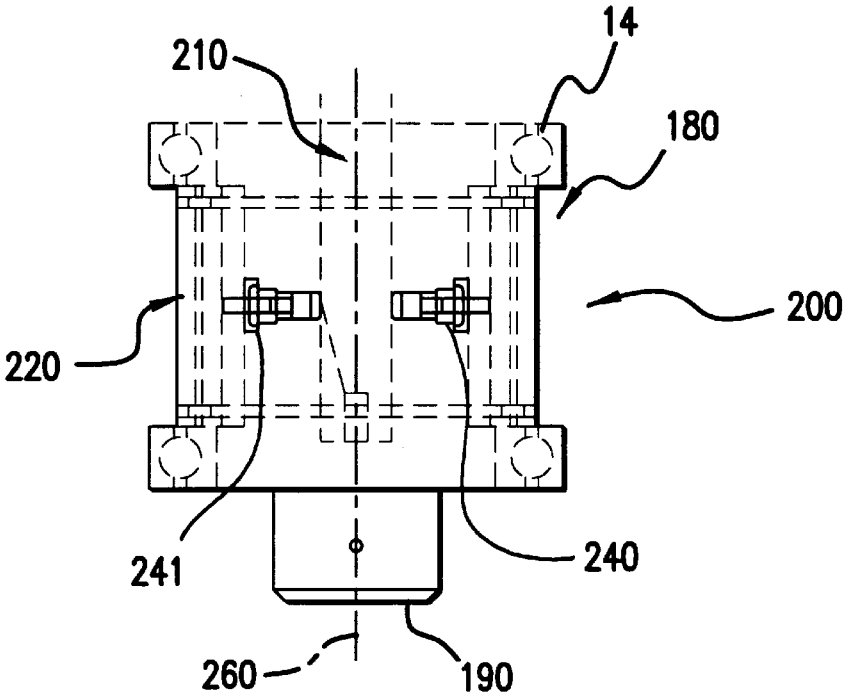
Figure 2D:
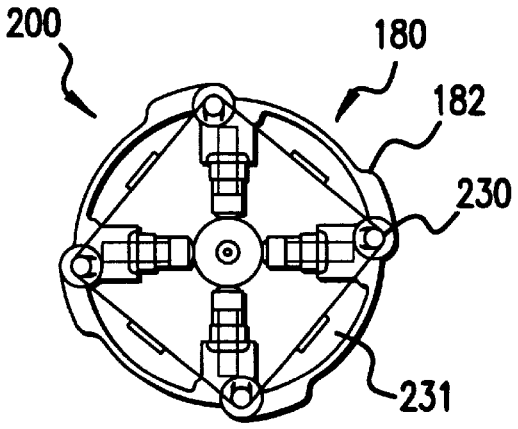

Wrench housing 11 is suspended by a bail housing 100 (FIG. 1*a*). Bail housing 100 includes a bail connector 101 for connection to a cable from which the entire wrench 10 can be hung. Bail joint 102 allows the wrench 10 to be used in a horizontal position, a vertical position, and many other intermediary positions while suspended from a cable attached to the bail connector 101.

Rotational energy from the flywheel 180 is transferred to the output drive 190 by a clutch 200. Clutch 200 is provided between the flywheel 180 and the output drive 190 for selectively transferring rotational energy from the flywheel 180 to the output drive 190. The clutch 200 is mounted to and rotationally isolated from the wrench housing 11 by housing bearings 12. Clutch bearings 14 are provided between the flywheel 180 and the clutch 200 so that the flywheel 180 can rotate about a central drive axis 260 when the clutch 200 is in a disengaged position.

A detailed description of the clutch 200 will now be given with reference to FIGS. 2*a*–2*d*.

The clutch 200 is concentric about a central drive axis 260 and includes a plurality of replaceable teeth or shock pins 220 arranged parallel to and concentrically spaced about the central drive axis 260. Shock pins 220 are movable from a disengaged position (FIGS. 2*a*–2*b*) to an engaged position (FIGS. 2*c*–2*d*) when a shifter rod 210 is caused to extend from air cylinder 170. Poppets 240 extend between the shifter rod 210 and each of the shock pins 220 such that when the shifter rod 210 extends from the pneumatic cylinder 170, the poppets 240 are guided by poppet guides 241 and forced against the shock pins 220 to cause the shock pins to move outwardly from the central drive axis 260 into an engaged position. Poppet guides 241 are preferably made of brass.

In the engaged position, the shock pins 220 extend into roller receiving cavities 182 that are formed in the flywheel 180. The roller receiving cavities 182 are large relative to the diameter of the shock pins to assure positive engagement of the clutch and facilitate synchronization of clutch engagement. When the shock pins 220 extend into the roller receiving cavities 182 in the flywheel 180, the clutch 200 is caused to rotate in conjunction with the flywheel 180 and rotational energy of the flywheel is transmitted through the clutch 200 to the output drive 190 which is connected to an output drive end of the clutch 200.

Rollers 230 are located at the ends of each of the shock pins 220. Roller return springs 231 are connected between each of the rollers 230 so that when the clutch is in the disengaged position and the shifter rod 210 is in a withdrawn position in pneumatic cylinder 170, the shock pins 220 will move inwardly towards the central drive axis 260 as a result of the tension present in the roller return springs 231.

The operation of the preferred embodiment will now be described. The wrench 10 is placed into position by connecting a cable to bail connector 101 and suspending the wrench 10 above a nut, bolt or other device that is intended to be removed by the wrench 10. The wrench housing 11 is then angled with respect to the bail housing 100 by rotating the wrench housing 11 about bail joint 102 such that the output drive 190 is connected to the nut, bolt or other fastener that is to be removed.

An operator then uses a keyed switch to provide energy to the drive motor 150 and thus impart rotational energy to the flywheel 180. The wrench 10 can be designed with a specific and known moment of inertia so that the exact torque output can be adjusted by simply varying the speed of the flywheel 180. The speed is preferably selected to be between 600 rpm and 1200 rpm. The rotational speed of the flywheel 180 is monitored by the operator with an integral tachometer. Once the desired speed is reached, the operator simultaneously depresses two clutch engagement buttons. This action will instantly and simultaneously shut off power to the drive motor 150 and activate the clutch 200 by extending the shifter rod 170 to project the shock pins and rollers 230 into the roller receiving cavities 182 of the flywheel 180. Accordingly, the rotational energy stored in the flywheel 180 is transmitted through the clutch 200 to the output drive 190. At this point, the rotational energy from the flywheel 180 is converted into a removal torque that is delivered to the nut, bolt or other fastener device attached to the output drive 190. If the delivered torque is greater than the resistance of the fastener, the fastener will start to rotate, and will continue to rotate until all stored energy has been expended. If the rotational energy stored in the flywheel 180 is less than what is required to overcome the resistance of the fastener, the flywheel 180, clutch 200 and output drive 190 will rebound due to torque reaction.

While torque reaction in the present invention can be substantially large, transmission of the torque reaction to the wrench housing 11 (and eventually to the cable or operator holding the wrench 10) is minimal. One reason the transmission of torque reaction to the housing 11 in the present invention is small is because housing bearings 12 are provided between the wrench housing 11 and the clutch 200. The housing bearings 12 rotationally isolate the wrench housing 11 from the flywheel 180 and clutch 200 so that a rotational change of direction of the flywheel 180 and the clutch 200 has little effect on the isolated wrench housing 11.

Another reason the transmission of torque reaction from the clutch 200 and flywheel 180 to the wrench housing 11 is minimized is because the flywheel 180, output drive 190 and clutch 200 are symmetrical about the central drive axis 260. Accordingly, upon rebound of the flywheel 180, output drive 190 and clutch 200 mechanisms from the resistance of the fastener, there will be no unbalanced forces-transmitted to the wrench housing 11. The majority of the torque reaction will be depleted in the form of reversed rotation of the flywheel 180, output drive 190 and clutch 200. This reversed rotation is facilitated by the housing bearings 12.

Finally, transmission of torque reaction to the wrench housing 11 is also minimized by disconnecting the input of the drive motor 150 from the drive gear 13 and flywheel 180. Disconnection of input from the drive motor 150 can be accomplished by shutting off electrical power to the drive motor 150 in coordination with the activation of clutch 200. Alternatively, a drive motor clutch mechanism can be installed in the transmission gear train between the drive motor 150 and the flywheel 180 such that the drive motor clutch mechanism disengages in coordination with the engagement of the clutch 200 to eliminate input from the drive motor 150 to the flywheel 180 when clutch 200 is engaged.

The wrench 10 may also include a control device which can automatically or manually repeat the process of converting the rotational energy stored in the flywheel 180 into torque applied to a fastener. The process can be repeated until the fastener is removed or sheared off. If the process is repeated manually, the operator can select a higher flywheel speed (rpm) such that more torque is produced for subsequent uses of the wrench.

A control panel is connected to the wrench 10 by a cable for remote operation. The control panel includes an on/off switch selector for forward and reverse rotation, dual shielded clutch engagement buttons, a speed adjustment controller, and a digital RPM indicator with accompanying torque output chart.

The wrench 10 may be used in factories or repair shops for tightening or removing fasteners without fear of breaking the fastener or the workpiece. A small amount of required set-up time allows the wrench 10 to be a cost-effective alternative to more elaborate electrically monitored power tools.

The wrench 10 may also be designed for larger applications, such as in oil refineries, petrochemical plants and power generation facilities for breaking free large fasteners that require extremely high levels of torque, i.e., 20,000–80,000 ft. lbs. The wrench 10 greatly decreases down time and the amount of personnel needed for operation of the wrench 10. In addition, the risk of accidental injury is greatly reduced because the operator does not need to handle the wrench 10 during operation.

Figure 3:
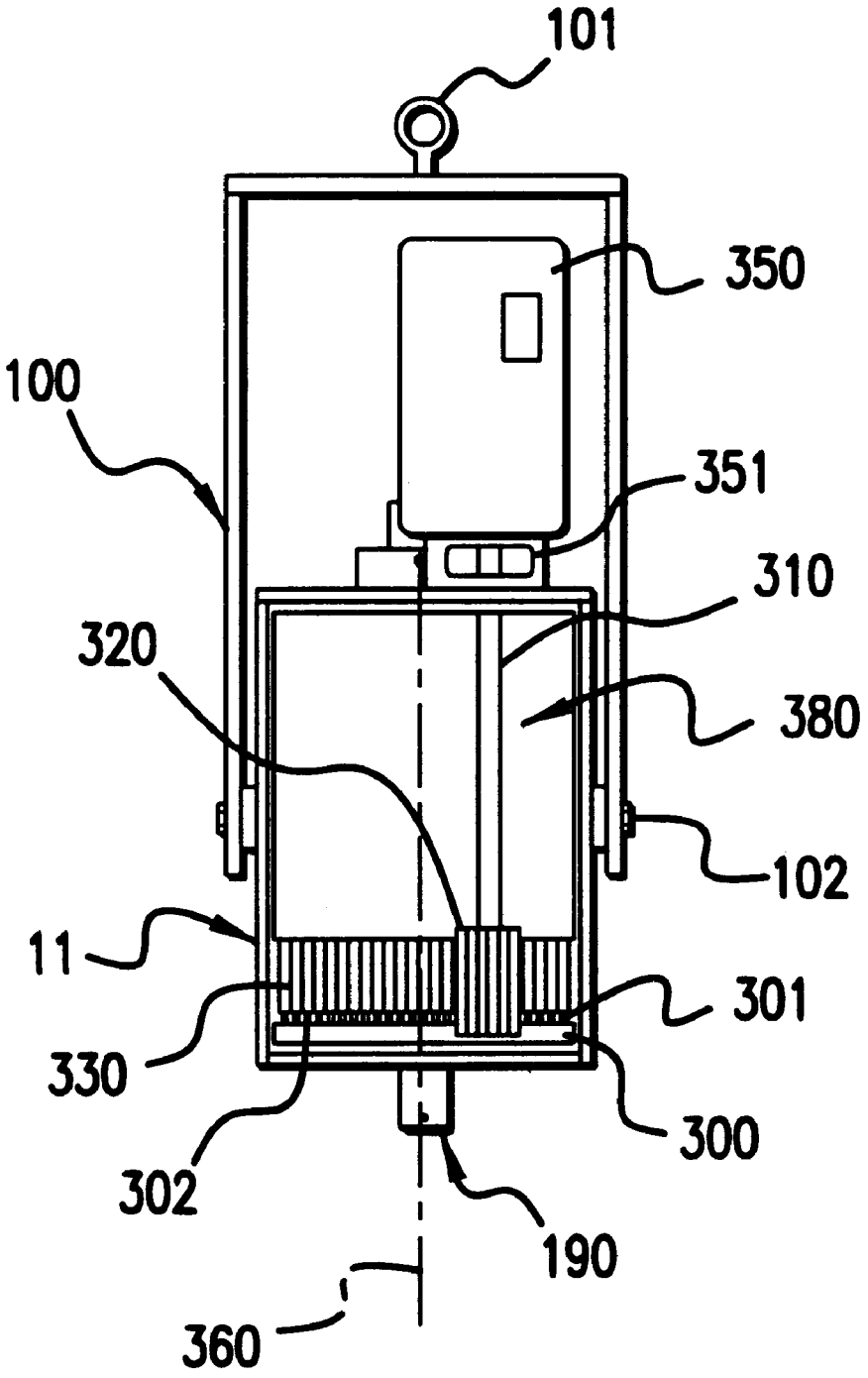
FIG. 3 is a cross-sectional view of a second embodiment of the present invention.

Only those portions of a second embodiment of the invention different from the above first embodiment will now be described with reference to FIG. 3.

In the second embodiment, the transmission of rotational energy from the drive motor 350 to the flywheel 380 is accomplished using a drive shaft 310. At an end of the drive shaft 310 closest to the drive motor 350, the drive shaft 310 receives rotary power through drive motor gear 351. Drive shaft gear 320 is located at the opposite end of the drive shaft 310 and provides rotational power to the flywheel through flywheel gear 330.

The clutch mechanism 300 of the second embodiment is a face plate clutch mechanism located at a face of the flywheel 380 located farthest away from the drive motor 350. The clutch mechanism 300 is concentric about a central drive axis 360 of the flywheel 380 in order to minimize torque reaction. The clutch mechanism 300 includes teeth members 301 that mate with corresponding groove members 302 when the clutch mechanism 300 is engaged.

Only those portions of a third embodiment of the invention different from the above first embodiment will now be described with reference to FIG. 4.

Figure 4:
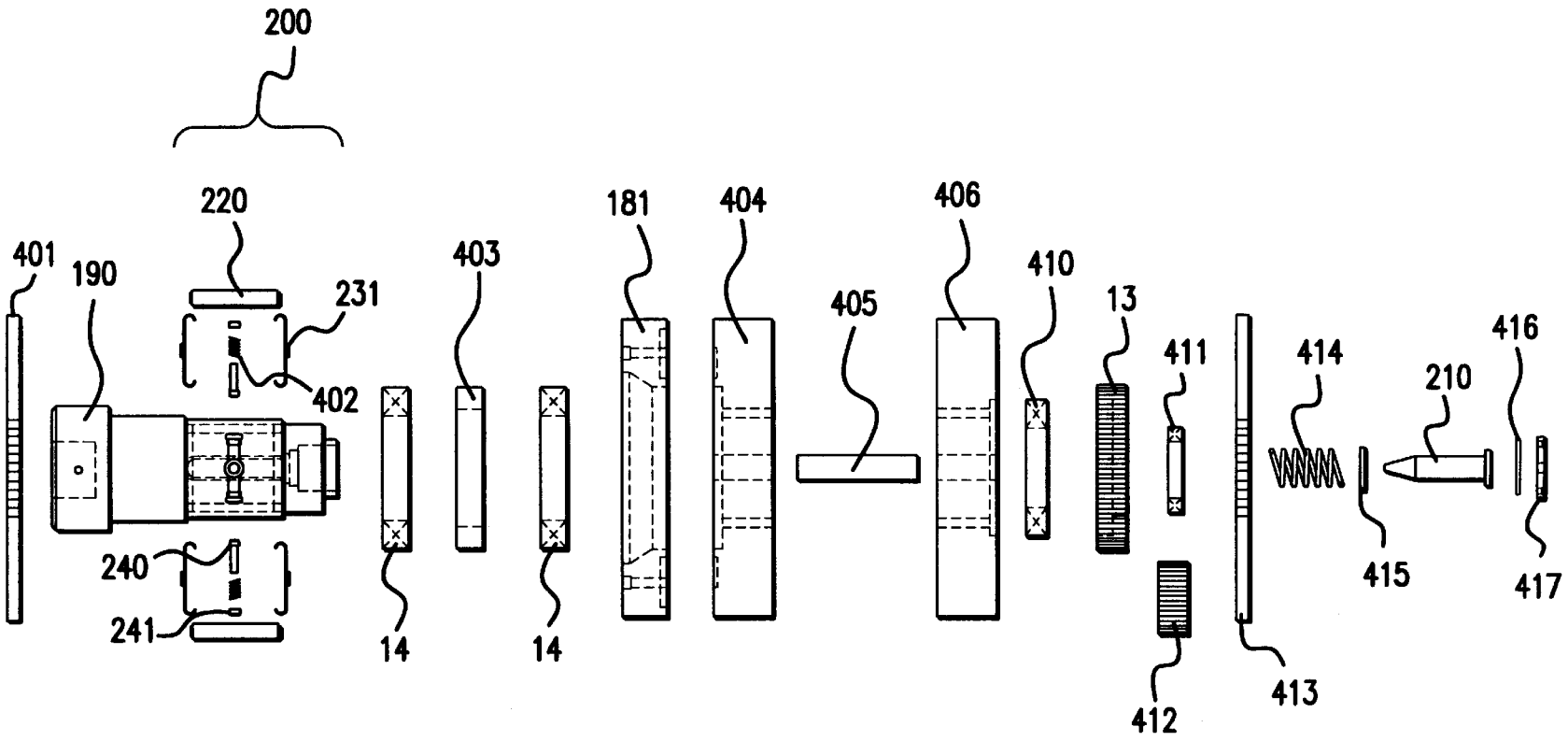
FIG. 4 is an exploded fragmentary view of a third embodiment of the present invention.

FIG. 4 shows an exploded fragmentary view of a third embodiment of the invention. Front enclosure plate 401 is attached to output drive 190 to enclose the front portion of the wrench 10. Output drive 190 is connected to clutch 200. Compression springs 402 are used to return poppets 240 to a disengaged position (see FIGS. 2*a*–2*b*) when shifter rod 210 is not extended from the pneumatic cylinder 170.

The flywheel of the third embodiment includes a flywheel front half 404 connected to a flywheel rear half 406 by flywheel dowels 405. A gear bearing 410 is located between the flywheel rear half 406 and the drive gear 13 such that the flywheel rear half 406 can rotate independent of drive gear 13. A rear enclosure plate bearing 411 is provided between the drive gear 13 and a rear enclosure plate 413 such that the drive gear 13 can rotate independent of the rear enclosure plate 413. An intermediary gear 412 mates with drive gear 13 to transmit rotational energy from a drive motor to the drive gear 13. Bearing spacer 403 may be provided between bearing 14 in this embodiment.

Shifter rod compression spring 414 is mounted with a front shifter rod O-ring 415 to shifter rod 210 such that the shifter rod 210 is returned to a retracted position after pneumatic cylinder 170 is deactivated. A rear shifter rod O-ring 416 and shifter rod housing cap 417 are provided at the rear of the shifter rod 210.

The cam mechanism 200 is activated by extending the shifter rod 210 causing the poppets 240 to force the shock pins 220 into engagement with the flywheel front half 404 and flywheel rear half 406. Rotational energy is then transmitted from the flywheel to the output drive 190 in the same manner as described with respect to the first embodiment of the invention.

A fourth embodiment of the present invention will now be described with reference to FIGS. 5–12. Only those portions of the fourth embodiment that are different from the above first embodiment will be described.

Figure 5:
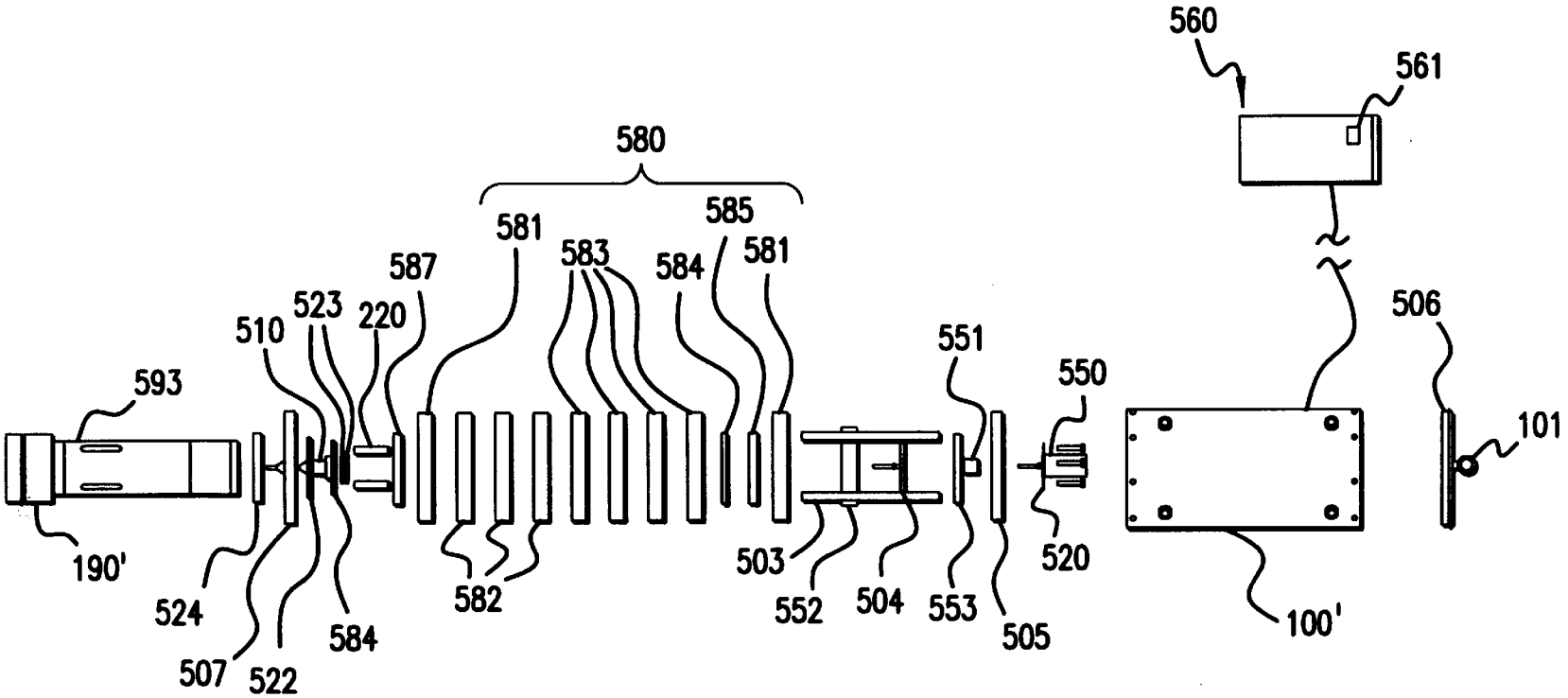
FIG. 5 is an exploded fragmentary view of a fourth embodiment of the present invention.
Figure 12:
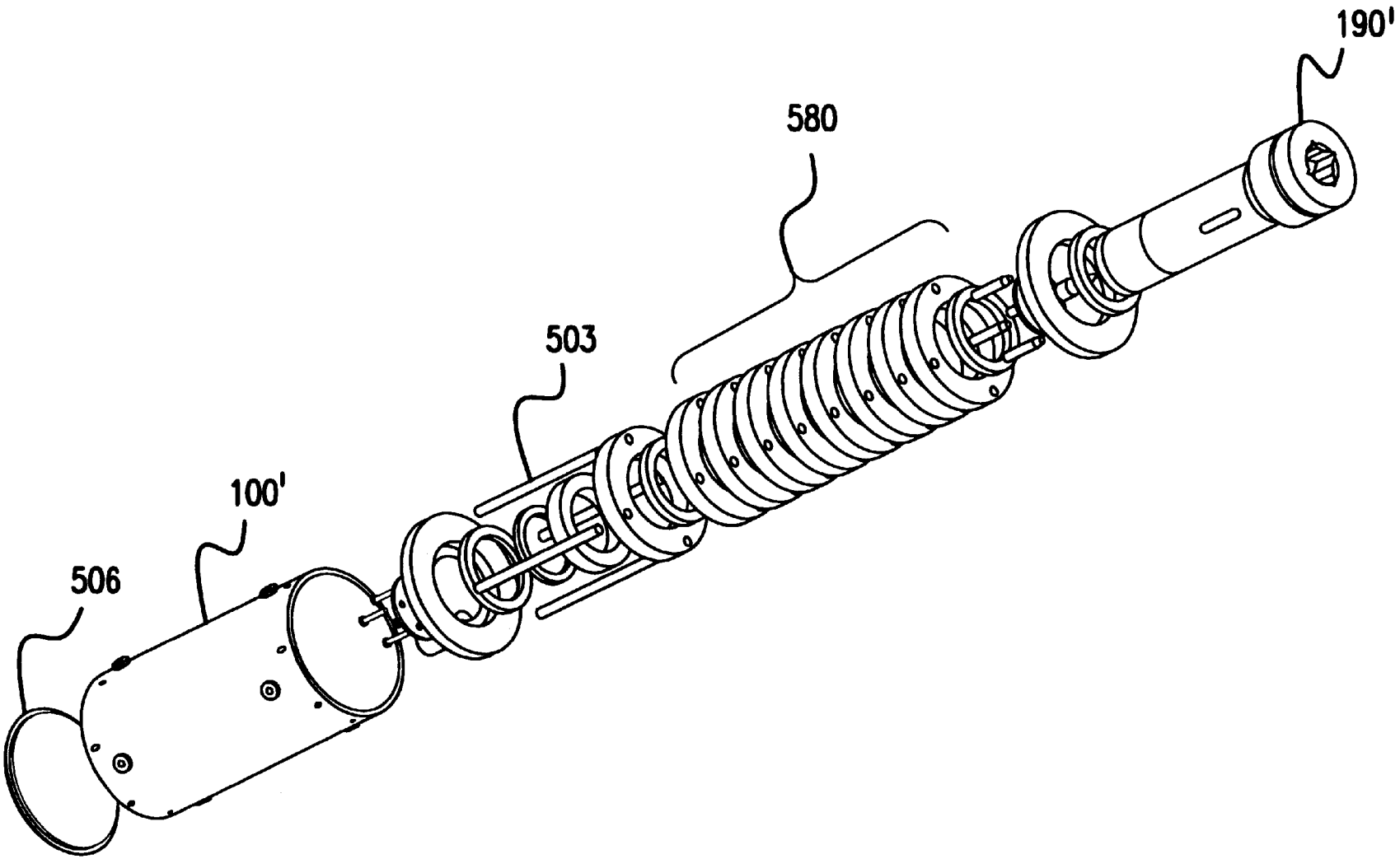
FIG. 12 is an exploded fragmentary view of the fourth embodiment of the present invention.

FIGS. 5 and 12 show an exploded fragmentary view of a fourth embodiment of the present invention. Flywheel set 580 includes outer flywheels 581 located at either end of the flywheel set 580. Drive cam-wheels 582 and slave flywheels 583 are provided between the outer flywheels 581 to complete the flywheel set 580. Connecting pins 503 ensure that the flywheel set 580 rotates in unison. The outer flywheels 581 include a recess for retaining a bearing to allow the flywheel set 580 to rotate freely about an inner shaft 593 that supports the output drive 190. The drive cam-wheels include internal cams 586 (FIG. 10) for cooperating with the clutch mechanism 500 to transmit rotational energy from the flywheel set 580 to the output drive 190'. The slave flywheels 583 preferably do not have cams or recesses for bearings.

Accordingly, the number of slave flywheels 583 can be changed in accordance with the load requirements for a particular wrench.

In the fourth embodiment of the present invention, each of the drive cam-wheels 582, slave flywheels 583 and outer flywheels 581 are a maximum of 2 inches thick and preferably have a 14 inch outer diameter. The relatively thin flywheel design permits easier handling and machining and yields greater flexibility in tailoring a wrench to the requirements of a specific application.

Flywheel snap rings 584 are provided at either end of the flywheel set 580 to prevent the upper flywheel bearing 585 and the lower flywheel bearing 587 from sliding on the inner shaft 593.

Upper cover 505 with spacer 504 and lower cover 507 with spacer 522 are also provided at either end of the flywheel set 580 and contain the flywheel set 580 and clutch mechanism 500 within the bail housing 100'. The lower cover 507 is rotationally isolated from the output drive 190' and flywheel set 580 by bearing 524 and the upper cover 505 is rotationally isolated from the output drive 190' and flywheel set 580 by drive gear bearing 553.

Figure 9:
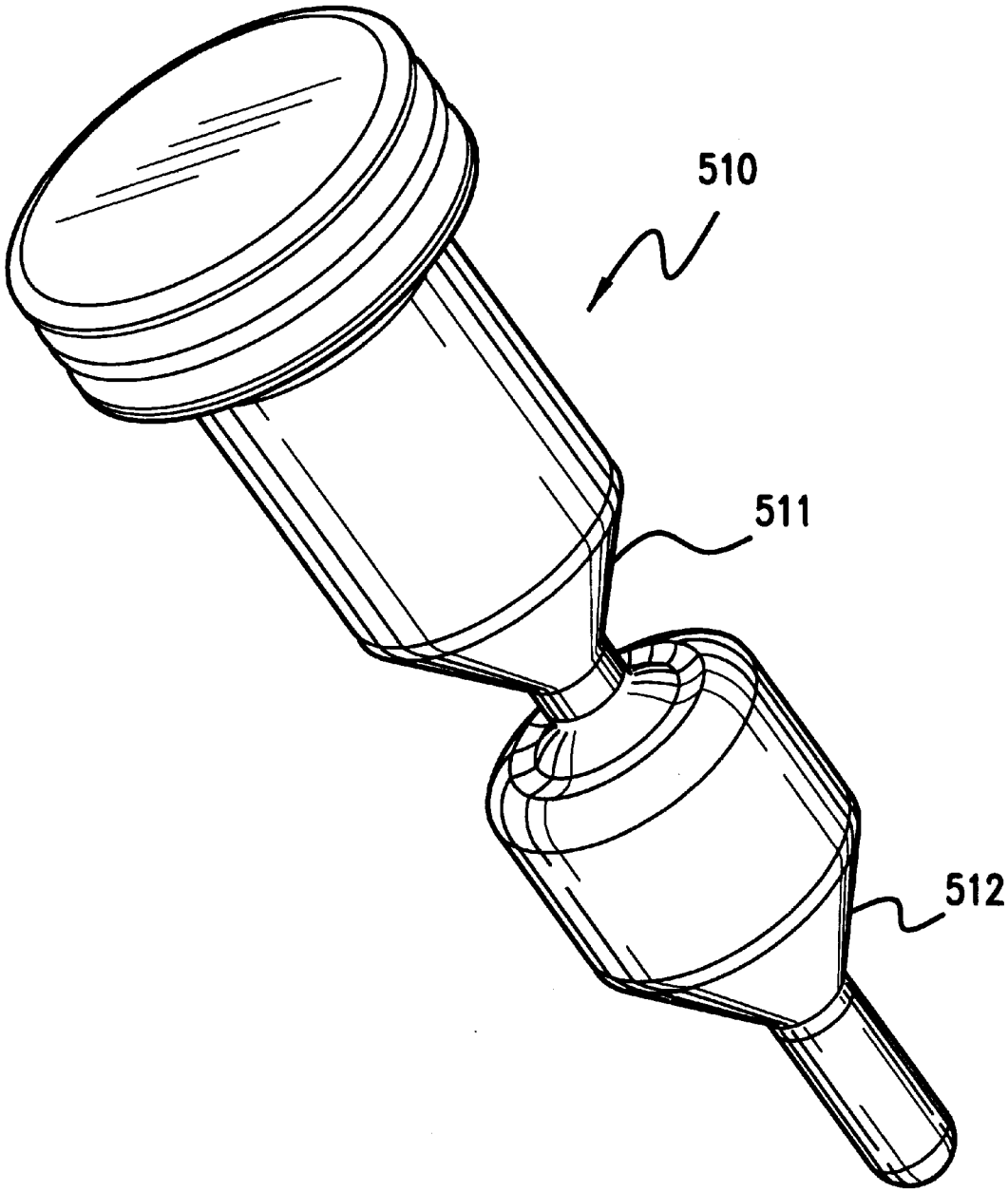
FIG. 9 is a perspective view of a shifter rod of the fourth embodiment of the present invention.
Figure 10:
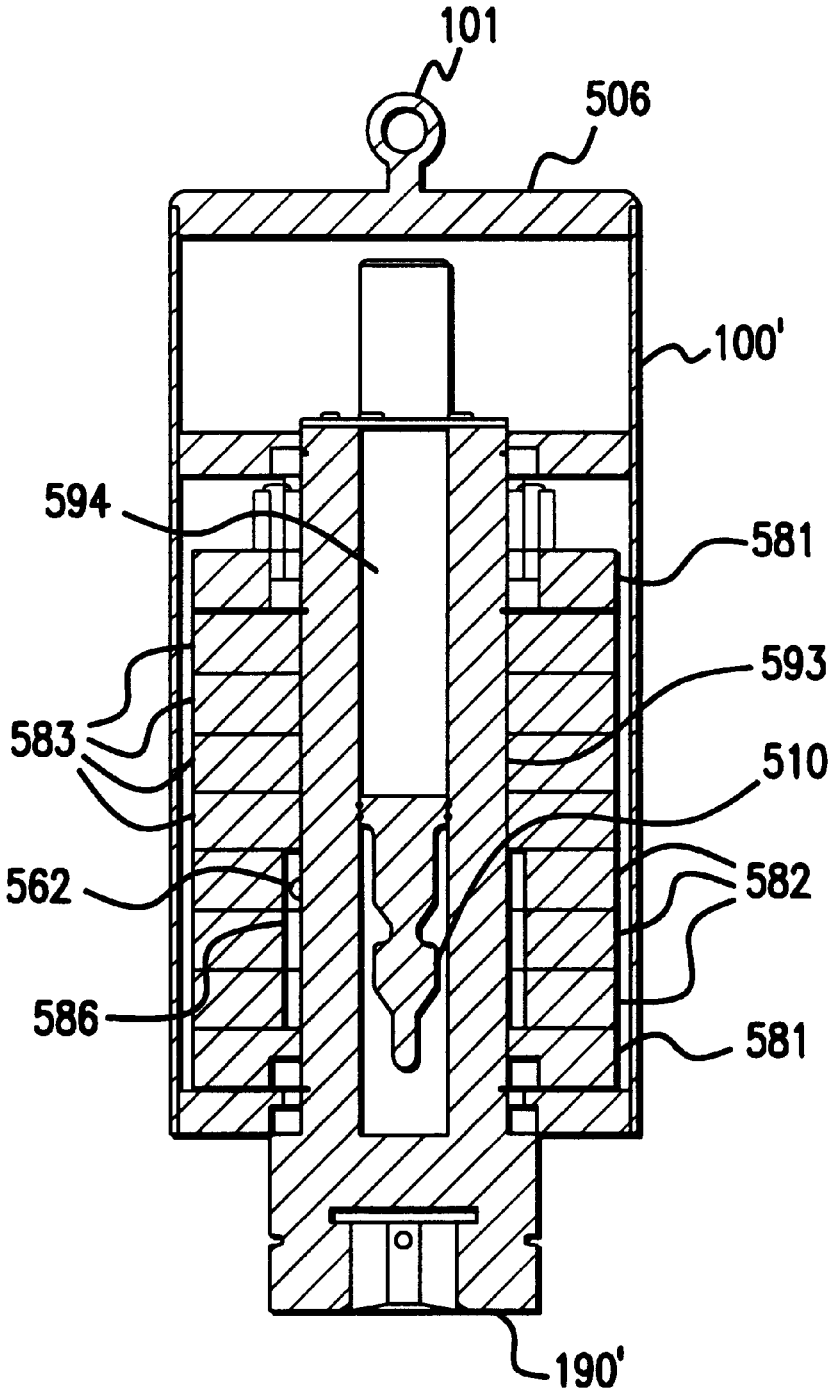
FIG. 10 is a cross-sectional view of the fourth embodiment of the present invention.
Figure 11A:
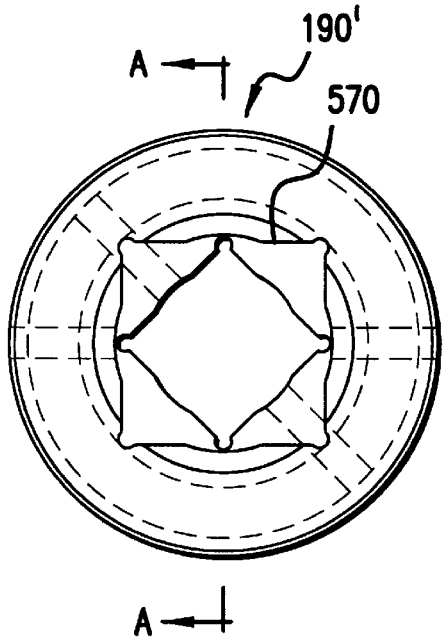
FIGS. 11*a*–11*c* are end, side and opposite end views of the output drive of the fourth embodiment of the present invention.
Figure 11B:
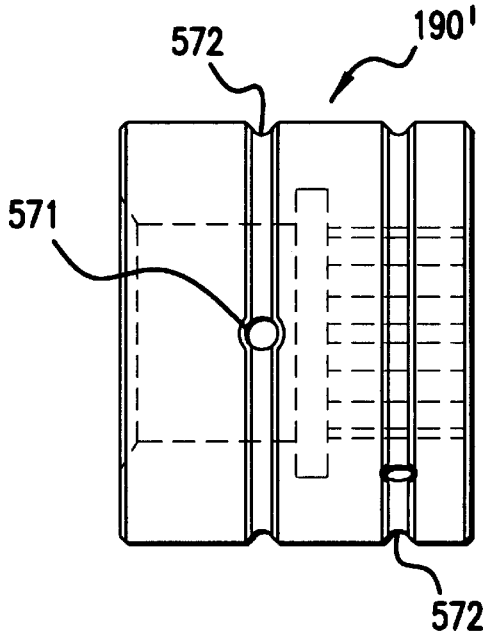
Figure 11C:
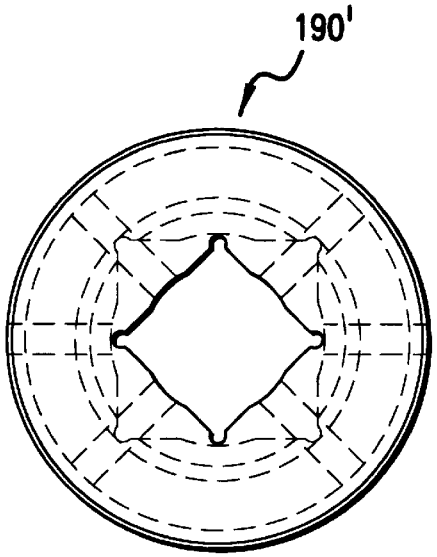
Figure 11D:
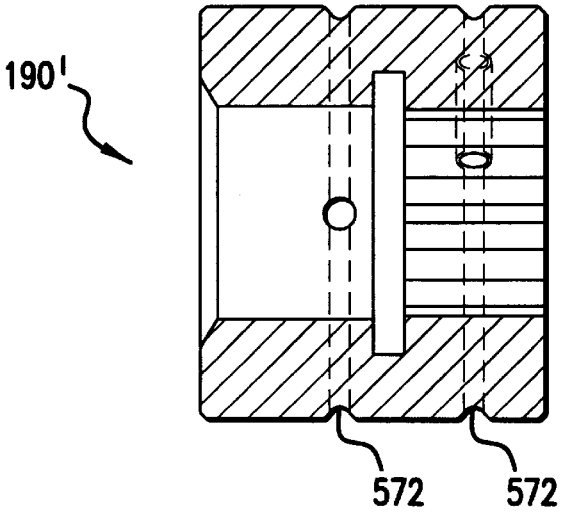
FIG. 11*d* is a cross-sectional view of the output drive of the fourth embodiment of the present invention taken along line A—A of FIG. 11*a*.

The shifter rod 510 of the fourth embodiment includes a first tapered surface 511 and a second tapered surface 512 (FIG. 9). The first and second tapered surfaces 511 and 512 act as camming surfaces to guide two sets of four poppets 590 outwardly to engage the shock pins 220 with the internal cams 586 (FIG. 10) on the drive cam-wheels 582. The two sets of four poppets 590 are spaced axially along the inner shaft 593 to provide a more uniform force against the shock pins 220 when the clutch mechanism 500 is activated. Each set of poppets is located approximately 1½ inches from an end of the shock pins 220. Poppet ball bearings 591 (FIG. 8) located at a distal end of the poppets 590 reduce friction between the poppets 590 and the shifter rod 510 for smooth operation of the clutch mechanism 500. The shifter rod 510 is outfitted with two shifter rod O-rings 523 to prevent a loss of power due to air leakage along the shifter rod 510 and to help align the movement of the shifter rod 510.

The shifter rod 510 may be provided with an internal bore to reduce its weight and increase its working efficiency. The internal bore should be threaded to allow easy connection to a removal tool should the shifter rod 510 ever become jammed. A vent (not shown) may also be provided in the bottom of the cylinder 594 (FIG. 10) to prevent the shifter rod 510 from losing power due to air pressure that might otherwise be present in the bottom of the cylinder 594.

Figure 6A:
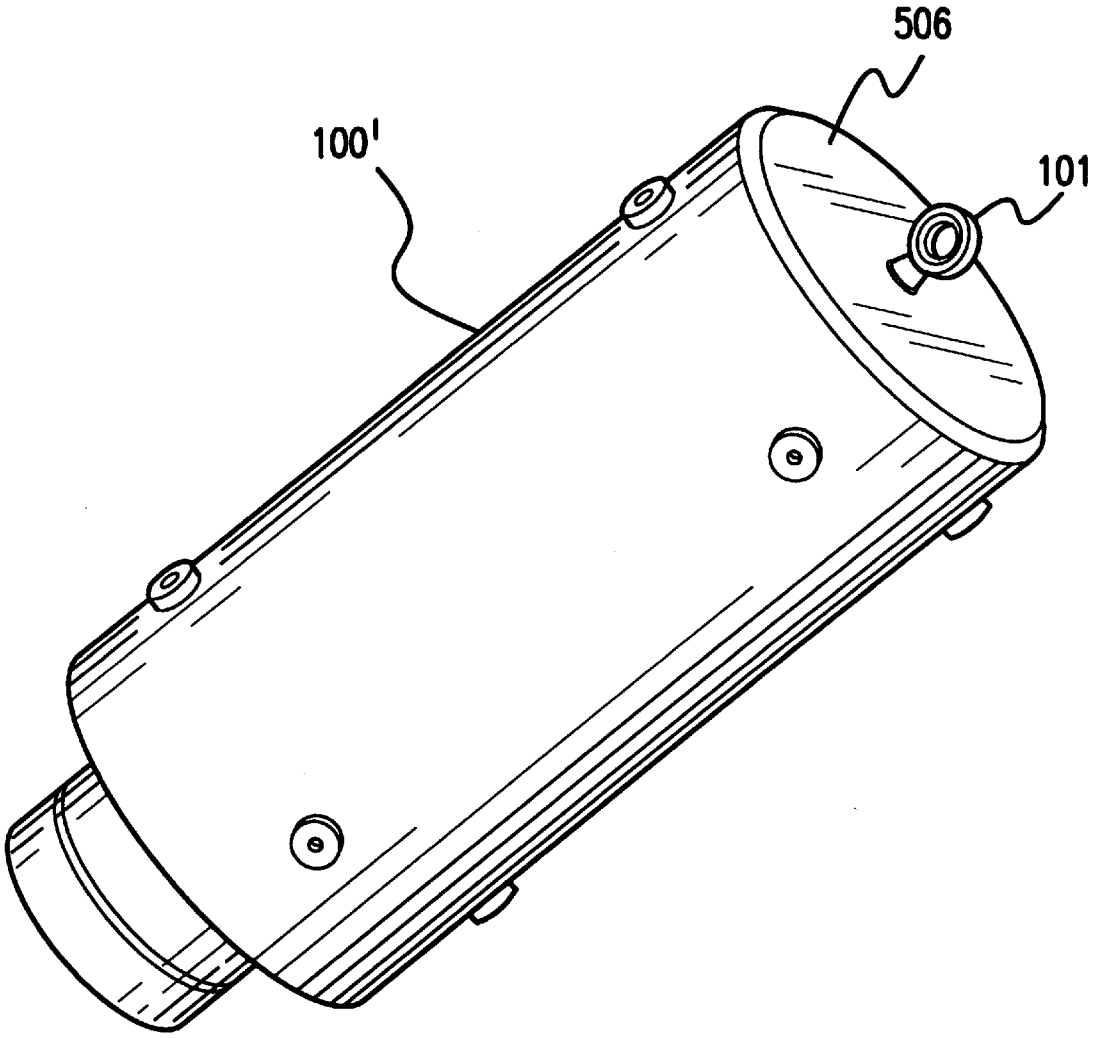
FIGS. 6*a*–6*b* are perspective assembled views of a fourth embodiment of the present invention.
Figure 6B:
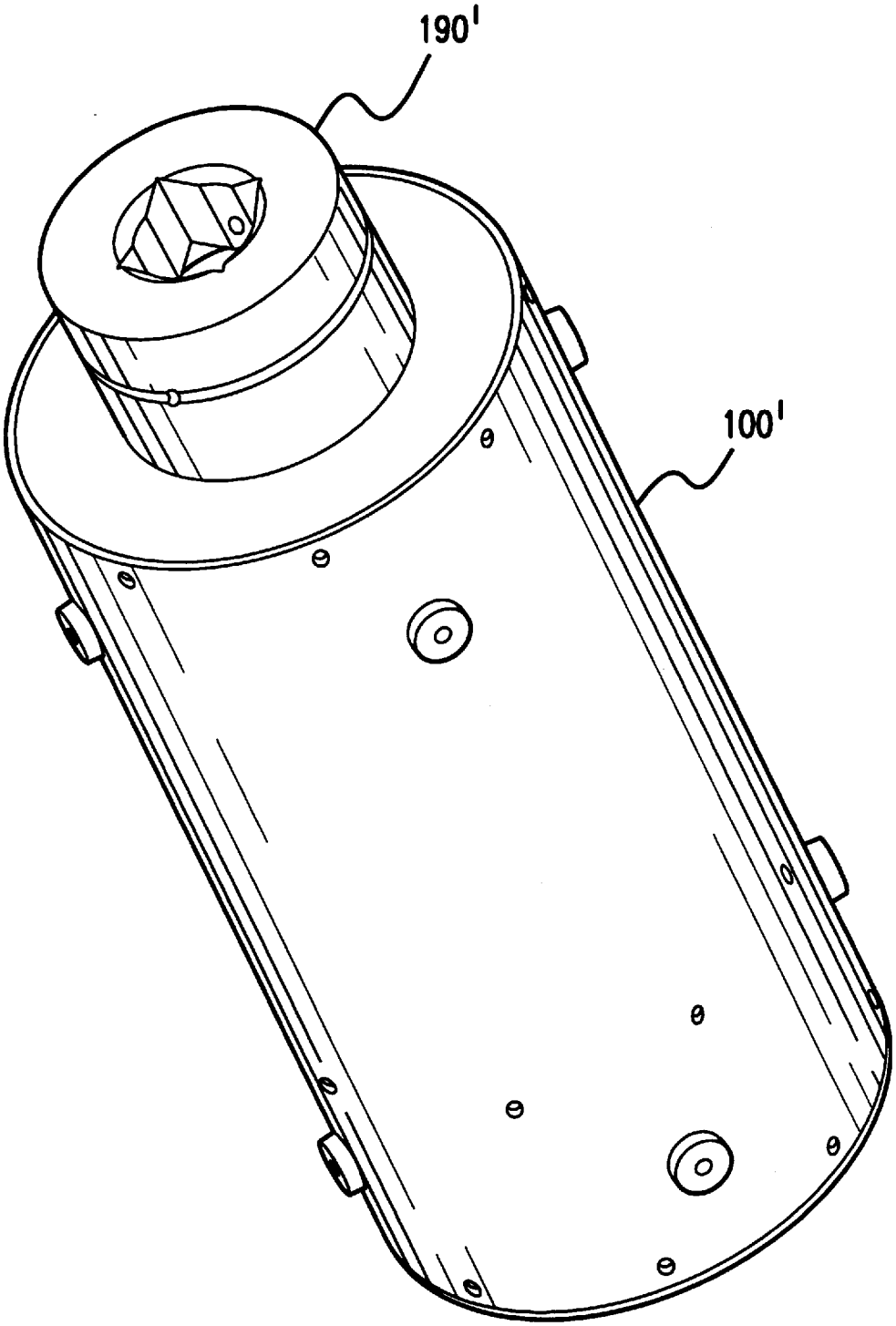

FIGS. 6*a* and 6*b* are perspective views of the fourth embodiment of the present invention viewed from different angles.

Figure 7:
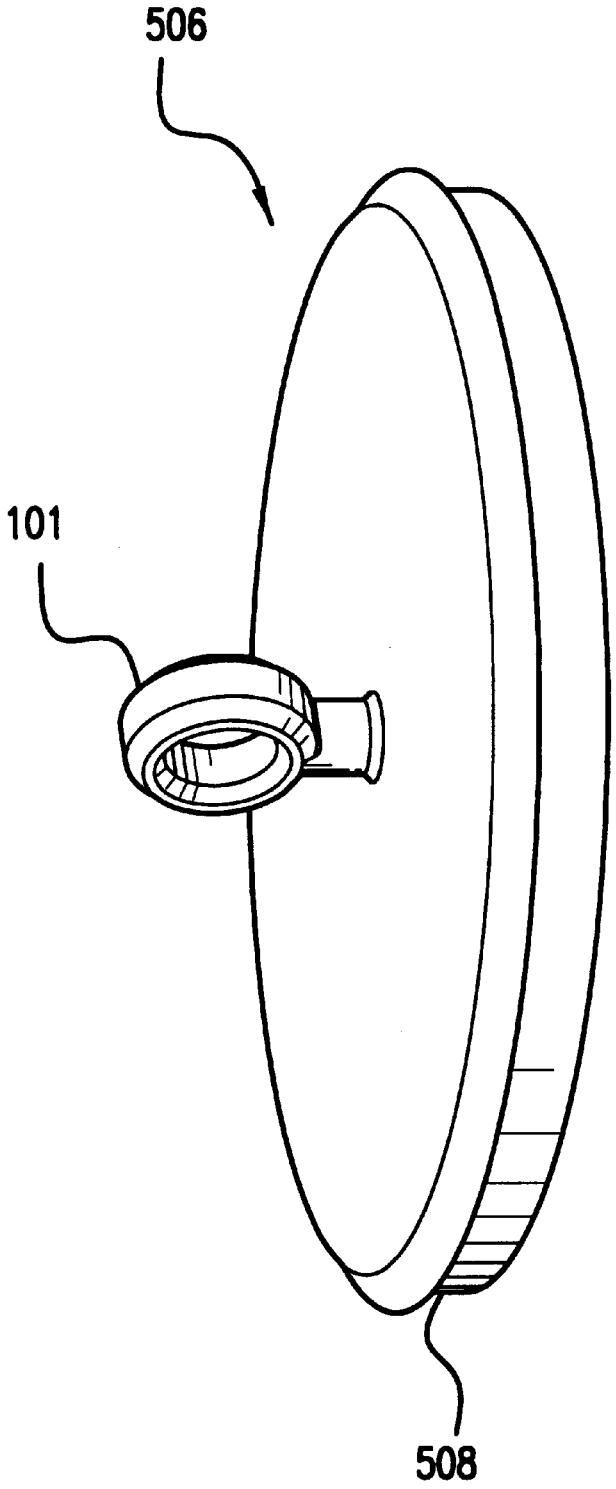
FIG. 7 is a perspective view of the upper cover plate of the fourth embodiment of the present invention.
Figure 8:
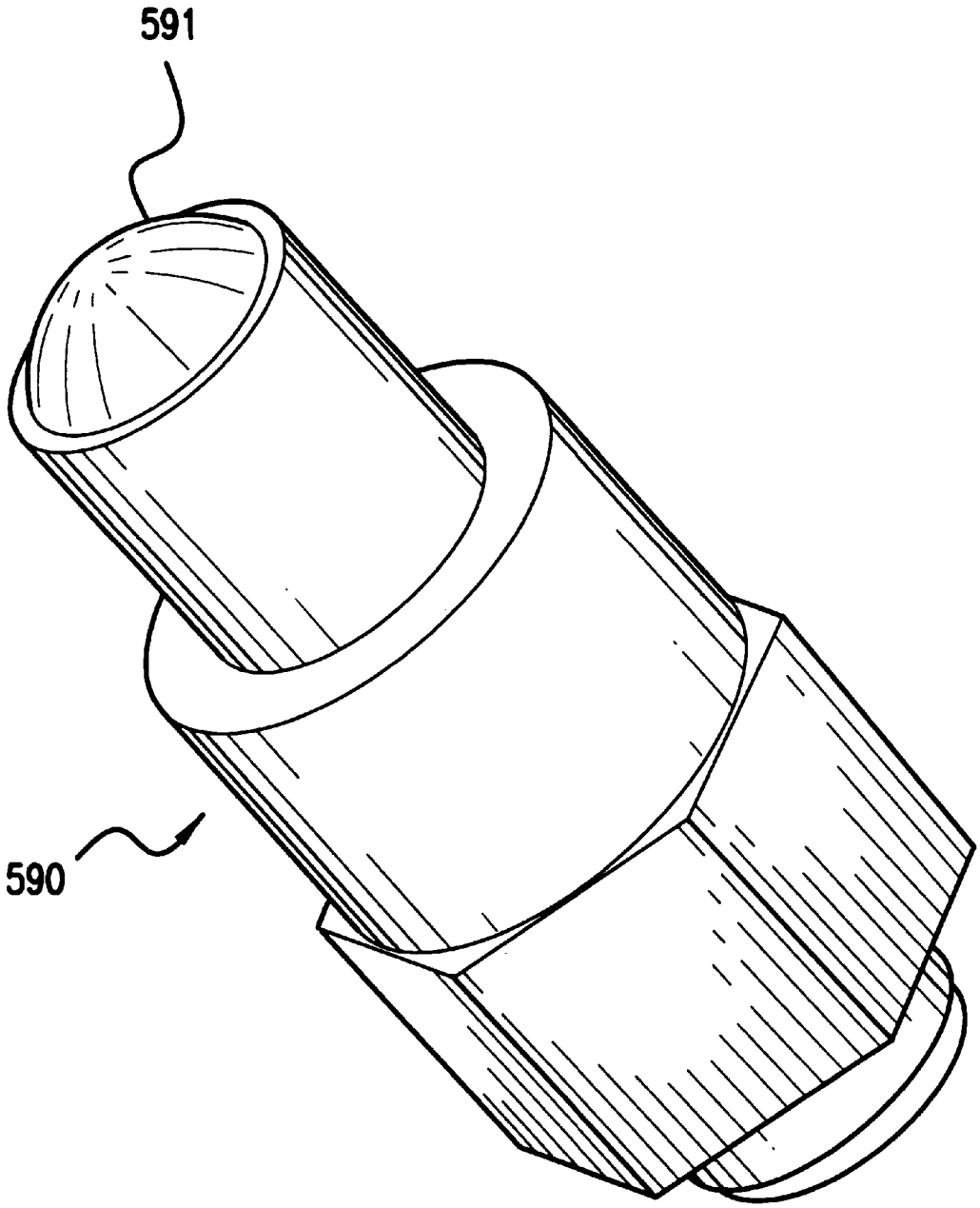
FIG. 8 is a perspective view of a poppet of the fourth embodiment of the present invention.

FIG. 7 is a perspective view of the upper cover plate 506 of the fourth embodiment of the present invention. The cover plate 506 is preferably made of 1 inch thick soft steel and has a step 508 on its outer diameter that allows it to set inside and on top of the bail housing 100'. The upper cover plate 506 may also include two rows of four welded bosses that preferably contain a 1½ inch deep 1¼ inch tapered pipe thread for connecting handles, lifting eyes, or other fixturing devices.

Motor 550 is attached to the cylinder head 520 and upper cover 505 and provides rotational energy to drive a set of drive gears 551,552. A drive gear bearing 553 allows the set of drive gears 551,552 to rotate relative to the bail housing 100'. Two high-speed motors may be used instead of one to provide a maximum speed of approximately 2,500 rpm. By using higher speed motors, the flywheel set 580 can be reduced in size and weight to provide a smaller wrench that is easy to manipulate, yet is still capable of producing a minimum of 60,000 ft. lbs. of torque and up to 100,000 ft. lbs. of torque.

FIGS. 11*a*–11*d* depict the output drive 190' of the fourth embodiment. The output drive 190' is shown as a female square 570 with a cross pin hole 571 and ring detents 572.

The wrench of the fourth embodiment may be operated remotely via a 25 foot disconnectable cable connected to a control box which includes a controller. The controller provides an operator the ability to control many functions of the wrench, including selecting a torque target manually within factory adjustable preselected limits and converting RPM to torque automatically. The controller is also preferably reversible and provided with a cycle counter and hour meter.

An electronic timing control 561 is provided with the controller 560. The electronic timing control 561 includes a sensor 562 (FIG. 10) located proximate the drive cam wheels 582 which senses the position of the flywheel set 580. When an optimum position of the flywheel set 580 relative to the shock pins 220 is detected by the sensor 562, the electronic timing control 561 causes the shifter rod 510 to extend from the cylinder 594 and activate the clutch mechanism 500.

The present invention is not to be limited to the above embodiments. Having now described the invention, it will be apparent to those skilled in the art that many changes and modifications can be made without departing from the spirit or scope of the invention as set forth in the appended claims.

What is claimed is:

1. A power driven wrench for selectively rotating a threaded fastening device relative to a correspondingly threaded member, the wrench comprising:

a housing;

an inertial mass rotatably supported along a rotational axis in the housing;

a drive motor selectively connected to the inertial mass for selectively rotationally driving the inertial mass to rotate about the rotational axis;

an output drive mechanism selectively connected to the inertial mass for selectively transferring rotational energy from the inertial mass to the fastening device;

a clutch located between the inertial mass and the output drive mechanism for selectively connecting the inertial mass to the output drive mechanism; and isolation devices located between the housing and the inertial mass, drive motor and clutch for rotationally isolating the inertial mass, drive motor and clutch from the housing such that torque reaction from the fastening member is substantially prevented from being transmitted to the housing.

2. The wrench of claim 1, wherein the isolation devices include bearings located between the housing and the clutch and between the clutch and inertial mass.

3. The wrench of claim 1 wherein the isolation devices include a coaxial mounting of the inertial mass, drive motor, clutch and output mechanism on the rotational axis of the housing.

4. The wrench of claim 1, wherein the isolation devices include deactivation switches for disconnecting the drive motor from the inertial mass when the clutch is connected to the inertial mass.

5. The wrench of claim 1, wherein the output drive mechanism transfers rotational energy of about 20,000–80,000 foot pounds to the fastening member.

6. A power driven wrench for selectively rotating a threaded fastening device relative to a correspondingly threaded member, the wrench comprising:

a housing;

an inertial mass rotatably supported along a rotational axis in the housing, the inertial mass including a plurality of cavities located about the rotational axis;

a drive motor selectively connected to the inertial mass for selectively rotationally driving the inertial mass to rotate about the rotational axis;

an output drive mechanism selectively connected to the inertial mass for selectively transferring rotational energy from the inertial mass to the fastening device;

a clutch located between the inertial mass and the output drive mechanism for selectively connecting the inertial mass to the output device, the clutch being coaxial with the inertial mass along the rotational axis and comprising:

a plurality of pins radially spaced about the rotational axis and each having a longitudinal axis parallel to the rotational axis, the plurality of pins being movable between a radially retracted disengaged position and a radially extended engaged position;

each of the plurality of the pins in the retracted position being withdrawn inside the clutch to allow the inertial mass to rotate relative to the output drive mechanism, each of the plurality of pins in the engaged position being radially extended into a corresponding one of the plurality of cavities in the inertial mass to transfer rotational energy from the inertial mass to the output drive mechanism.

7. The power driven wrench of claims 6, wherein each of the plurality of cavities includes a bottom section and two side sections, each of the plurality of pins in the engaged position being confined between the clutch and the one side of the corresponding cavity.

8. The power driven wrench of claim 6, further comprising a sensor for determining a position of the plurality of cavities relative to the plurality of pins, the plurality of pins being moved from the retracted position to the engaged position in response to the sensor determining the position of the cavities.

9. The power driven wrench of claim 6, wherein the inertial mass includes a plurality of flywheels stacked together for rotation in unison, a portion of the plurality of flywheels including the plurality of cavities, a remaining portion of the plurality of flywheels being changeable in number in accordance with load requirements for the wrench.

10. The power driven wrench of claim 6, further comprising a shifter rod axially movable along the rotational axis and engaging the plurality of pins for moving the plurality of pins between the retracted and engaged positions.

11. The power driven wrench of claim 6, wherein the shifter rod is tapered to provide a camming surface for moving the plurality of pins.

12. The power driven wrench of claim 11, wherein the shifter rod has first and second tapered surfaces to provide a uniform force against the plurality of pins.

13. The power driven wrench of claim 6, wherein the output drive mechanism transfers rotational energy of about 20,000–80,000 foot pounds to the fastening member.

* * * * *